US011376877B2

(12) United States Patent
Gonzalez Perello et al.

(10) Patent No.: US 11,376,877 B2
(45) Date of Patent: Jul. 5, 2022

(54) PRINTER CARRIAGE ARRANGEMENTS

(71) Applicant: Hewlett-Packard Development Company, L.P., Spring, TX (US)

(72) Inventors: Daniel Gonzalez Perello, Sant Cugat del Valles (ES); Nestor Luid Pinol, Sant Cugat del Valles (ES); Adria Olmos Marin, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/262,262

(22) PCT Filed: Jan. 29, 2019

(86) PCT No.: PCT/US2019/015539

§ 371 (c)(1),
(2) Date: Jan. 22, 2021

(87) PCT Pub. No.: WO2020/159475

PCT Pub. Date: Aug. 6, 2020

(65) Prior Publication Data

US 2021/0347188 A1 Nov. 11, 2021

(51) Int. Cl.

| | |
|---|---|
| ***B41J 25/34*** | (2006.01) |
| ***B41J 19/00*** | (2006.01) |
| ***B41J 23/26*** | (2006.01) |
| ***B41J 25/308*** | (2006.01) |

(52) U.S. Cl.

CPC ..... *B41J 25/34* (2013.01); *B41J 19/00* (2013.01); *B41J 19/005* (2013.01); *B41J 23/26* (2013.01); *B41J 25/308* (2013.01)

(58) Field of Classification Search

CPC . B41J 25/34; B41J 19/005; B41J 23/26; B41J 25/308; B41J 19/00

See application file for complete search history.

(56) References Cited

U.S. PATENT DOCUMENTS

| | | | | |
|---|---|---|---|---|
| 3,798,414 | A | 3/1974 | Di Muriaglio | |
| 4,846,032 | A | 7/1989 | Jampathom et al. | |
| 6,565,272 | B2 * | 5/2003 | Kelley | B41J 25/308 400/59 |
| 9,638,550 | B2 | 5/2017 | Vokinger et al. | |
| 2003/0016266 | A1 | 1/2003 | Urselmann | |
| 2008/0000371 | A1 | 1/2008 | Okada et al. | |
| 2012/0011714 | A1 | 1/2012 | Hattori et al. | |
| 2013/0133187 | A1 * | 5/2013 | Yman | H05K 13/0469 239/722 |

FOREIGN PATENT DOCUMENTS

| | | | |
|---|---|---|---|
| FR | 2974897 | B1 | 11/2013 |
| JP | 2014156079 | A | 8/2014 |

* cited by examiner

*Primary Examiner* — Henok D Legesse

(74) *Attorney, Agent, or Firm* — HP Inc. Patent Department

(57) ABSTRACT

It is hereby disclosed a carriage arrangement, in particular, a carriage arrangement suitable for a printing system comprising: a carriage; a carriage beam; and a drive mechanism; wherein the carriage is to move along a longitudinal direction of the carriage beam upon action by the drive mechanism and wherein the carriage arrangement comprises a beam compensation mechanism to exert a variable compensating force on the carriage beam, the variable compensating force depending on a deformation amount of the carriage beam.

15 Claims, 5 Drawing Sheets

PRINTER CARRIAGE ARRANGEMENTS

BACKGROUND

In a printing operation of a printing device, a carriage, which includes a print head, is moved relative to a print media item for ejection of print agent from the print head onto the print media item. The carriage may move along a carriage guide and may be propelled along the carriage guide by a drive mechanism. A carriage such as that described above can be employed in printing devices for printing inks and in 3D printing devices wherein layers of build material are selectively solidified by layers with the aid of printing fluids that are printed to the layers of build material.

Similarly, in a scanning operation of a scanning device, which may be included in multifunction printers (MFPs) and other devices, a document to be scanned is placed on a transparent window for scanning. The document may be placed, face down (i.e., where "face" refers to the side of the document to be scanned) on one side of the window. A carriage, which has coupled thereto a scan bar including optics for scanning the document, may then be moved along the length of the opposite side of the window, e.g., along a carriage rod. The carriage, and thus the scan bar, may be propelled along the carriage rod by a drive mechanism that includes a motor and a flexible belt.

BRIEF DESCRIPTION OF THE DRAWINGS

Various example features will be apparent from the detailed description which follows, taken in conjunction with the accompanying drawings, wherein.

DETAILED DESCRIPTION

Figure 1:
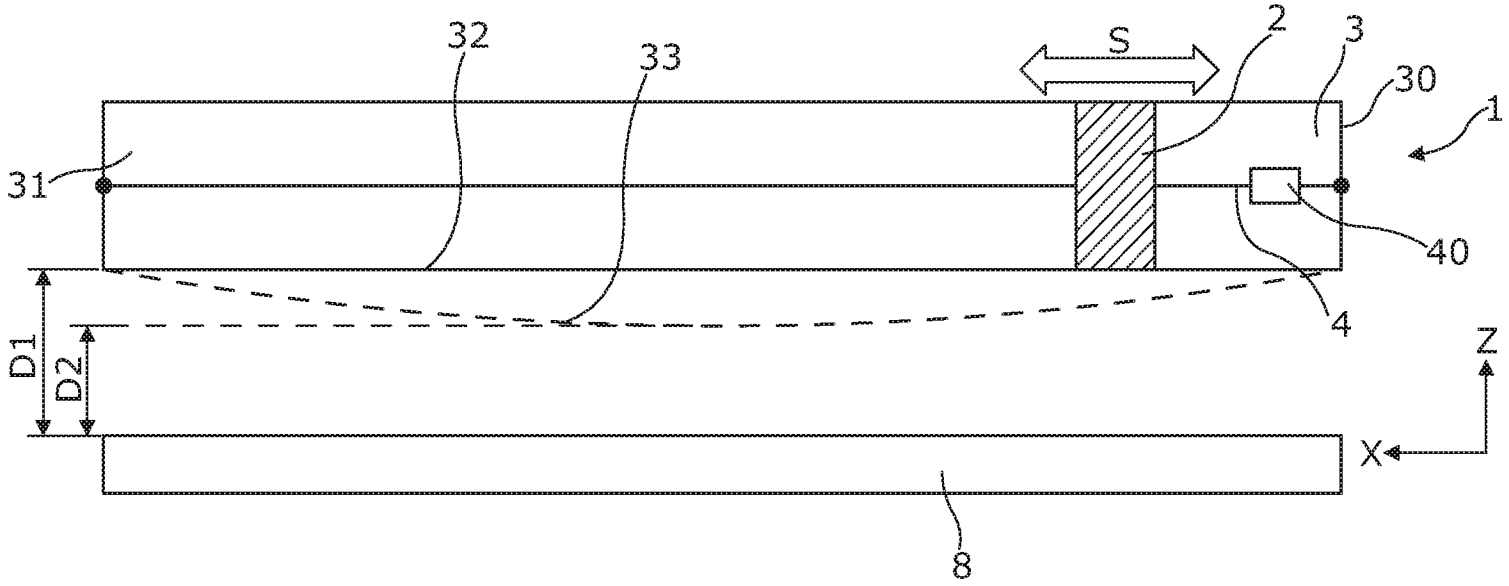
FIG. 1 schematically shows a front view of an example of a carriage arrangement.

In the following description and figures, some example implementations of print apparatus, print systems, and/or printers are described. In examples described herein, a "printer" or a "printing system" may be a device to print content on a physical medium (e.g., paper, textiles, a layer of powder-based build material, etc.) with a print material (e.g., ink or toner). For example, the printer may be a wide-format print apparatus that prints latex-based print fluid on a print medium, such as a print medium that is size A2 or larger. In some examples, the physical medium printed on may be a web roll or a pre-cut sheet. In the case of printing on a layer of powder-based build material, the print apparatus may utilize the deposition of print materials in a layer-wise additive manufacturing process. A printer may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

In one example, the present disclosure describes a carriage for use in a printing device. However, in another example, the carriage of the present disclosure can be incorporated in a scanning device.

The carriage disclosed herein comprises a drive mechanism that is used to propel the carriage along a drive direction, the carriage may comprise a coupled a print head, when printing a document. Similarly, in the case of a scanning device, the drive mechanism that is used to propel a carriage, to which is coupled a scan bar, when scanning a document comprises a motor coupled to the carriage as to, upon activation of the motor, move together with the carriage.

Moreover, the carriage is to move in the drive direction along a carriage beam. The carriage beam is a beam that extends longitudinally along the drive direction thereby defining the movement limits of the carriage and may have different configurations including its shape and material. In an example, the beam is a triangular prism wherein one of the faces of the prism acts as a support for the carriage, for example, one of the faces of the carriage beam may comprise guiding elements that are to contact the carriage to define its movement along the drive direction.

It is therefore hereby disclosed a carriage arrangement comprising:

a carriage;

a carriage beam;

a drive mechanism;

wherein the carriage is to move along a longitudinal direction of the carriage beam upon action by the drive mechanism and wherein the carriage arrangement comprises a beam compensation mechanism to exert a variable compensating force on the carriage beam, the variable compensating force depending on a deformation amount of the carriage beam.

In an example, the beam compensation mechanism exerts a force in the longitudinal direction of the carriage beam, in particular, the compensation mechanism may exert a force outwards in the longitudinal direction of the carriage.

Further, the beam compensation mechanism may, in an example comprise an actuator to exert the compensating force on the carriage beam. The actuator may comprise, e.g., an elastomer.

In a further example, the beam compensation mechanism may comprise a sensor to determine a distance between the beam and a reference. With this configuration, the beam compensation mechanism may also comprise a controller coupled to the sensor, whereby the controller may be to issue a signal to a closed-loop actuator being the closed-loop actuator to exert the compensating force on the carriage beam.

Examples of sensors may be any type of wireless distance and/or presence sensors, e.g., an optical sensor or an inductive sensor.

Also, it is disclosed a printing system comprising:

a print medium support surface to support a print medium;

a conveyor to transport the print medium along a media path direction a carriage extending over the print medium support, the carriage having a longitudinal direction perpendicular to the media advance direction wherein the system comprises a beam compensation mechanism comprising an actuator to exert a variable compensating force on the carriage beam.

In an example, the variable compensating force is a force in the longitudinal direction of the carriage beam, in particular, outwards in the longitudinal direction of the carriage beam.

Moreover, the actuator may be, e.g., a pre-loaded elastomer attached to the carriage beam wherein the pre-load may be configurable by the user and/or a controller.

Also, the actuator may be an open-loop actuator or a closed-loop actuator. The system may further comprises a sensor to determine a calibration distance associated to the carriage beam and the print medium or the print medium support and may also comprise a controller, the controller being to receive the calibration distance, to determine the variable compensating force in view of the calibration distance, and to control the actuator to exert the variable compensating force in view of such calibration signal.

It is further disclosed a method to compensate for carriage beam deformations in a printing system comprising a carriage associated to the carriage beam and a compensation mechanism coupled to the carriage beam as to exert a variable compensating force on the carriage beam, the method comprising:

determining a reference distance; and adjusting the variable compensating force based on the reference distance FIG. 1 shows an example of a carriage 2 for use as part of a printing system 1. In the example of FIG. 1, it is shown part of a printing system 1 wherein some elements have been removed to increase the intelligibility of the figure. The printing system comprises a carriage 2 that is to house a printing element, e.g., a printhead or, in another example, a scanner. The printing system comprises a beam 3 with a length that defines the travel distance of the carriage 2 in a swath direction S, in particular, the beam 3 may comprise a carriage guide that guides the carriage along its movement.

In an example, the carriage 2 of FIG. 1 comprises a drive mechanism or an impelling mechanism. The drive mechanism may be attached to the printing system, for example, to the carriage 2 so that, in operation, the drive mechanism moves together with the carriage 2. The drive mechanism of FIG. 1 may include a motor and an intermediate element to contact the beam thereby achieving a relative movement between the beam 3 and the carriage 2.

During a printing operation, an important parameter to maintain image quality is the pen-to-reference space, i.e., the distance between the printheads and a reference surface 8 that, in some examples, may be a reference 8 in the chassis of a printer, a platen, or the substrate to be printed. In the case in which the substrate is used to determine such a parameter it may be referred to as pen-to-paper space (PPS).

In printing systems in which the substrate may be subject to heat, the beam 3 may suffer from deformations that, in turn, influence the pen-to-reference space (PRS). As shown in FIG. 1, the PRS during a calibration or set-up proceeding may be determined by the beam in an undeformed configuration 32 as a reference distance D1. Then, during a printing operation the beam may deform. The deformed beam 33 causes the carriage 2 to be at a different distance than in the calibration proceeding and, therefore, modifying the PRS to a deformed-beam distance D2.

In order to compensate for such deformations, modifications may be performed at software level, but such modifications may not be enough to maintain a high image quality. To achieve a mechanical compensation on the beam 3, the carriage arrangement may comprise a beam compensation mechanism that exerts a force on the beam 3 as to compensate for possible deformations of the beam 3. In an example, the beam compensation mechanism comprises a rod 4 and an actuator 40 so that the beam compensation mechanism exerts a force in the longitudinal direction of the beam, e.g., outwards, and prevents the beam from deforming and, therefore, helping maintain the PRS substantially constant, or at least, reduce possible deviations in the PRS.

The actuator 40 may be, for example, an elastomer that may be pre-loaded as to exert a force on the beam 3 that increases as the deformation of the beam 3 increases, e.g., the elastomer may be a spring.

In an example, the beam 3 has a substantially rectangular surface over which the carriage is located, this substantially rectangular surface comprises a first lateral side 30, a second lateral side 31 and a bottom side that defines the distance between the carriage and the beam, i.e., the PRS. The actuator 4 may be provided to exert a longitudinal force, e.g., on the lateral sides 30, 31 of the beam 3.

In the example of FIG. 1 it is shown that the actuator 40 may be a passive element such as, e.g., an elastomer with a pre-load wherein the pre-load may be configurable by a user, e.g., by manual interaction with the actuator. In a further example, the actuator 40 may be an open-loop actuator, for example, an actuator that modifies the force exerted on the beam 3 depending on a signal from a sensor such as a position associated to the beam or a temperature.

Figure 2:
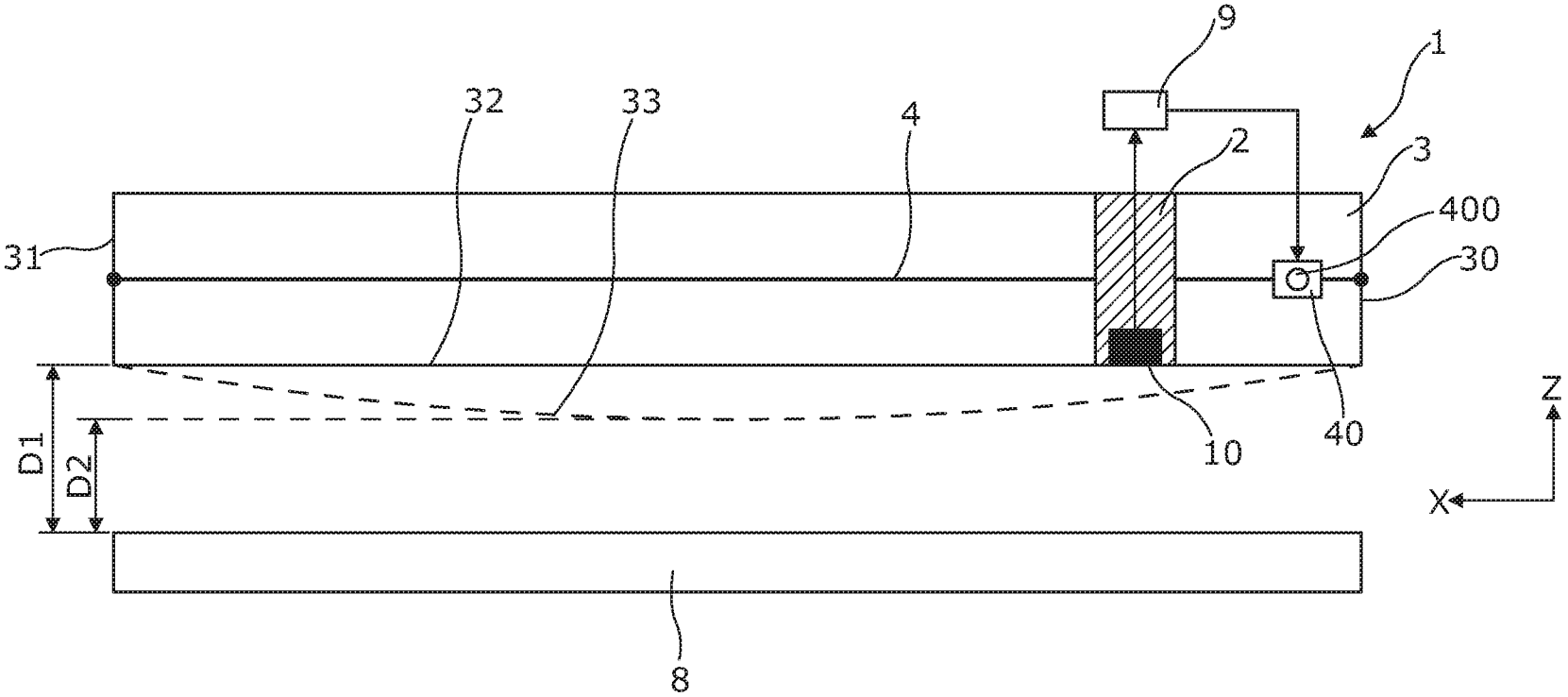
FIG. 2 schematically shows a front view of another example of a carriage arrangement

FIG. 2 shows a further example wherein the actuator 40 may be a closed-loop actuator, e.g., an actuator that performs a measurement, compares the measurement with a PRS target and determines the force to be applied by the actuator 40 to compensate for a deformation on the beam 3.

In the example of FIG. 2, the carriage arrangement comprises a sensor 10 that, in an example, may be a distance sensor such as an optical sensor attached to the carriage as to determine a distance associated to a printhead a reference 8. The sensor 10 may comprise a communication channel with a controller 9 thereby issuing a measuring signal associated to the measured distance. The controller 9 may also comprise a communication channel with a communication module 400 within the actuator 40 so that the controller 9 may issue an actuating signal towards the actuator 40 and the actuator may exert a compensating force on the beam 3 associated to the actuating signal.

The controller 9 may be a combination of circuitry and executable instructions representing a control program to perform the above-mentioned operations. In an example, the controller 9 may be implemented using machine readable instructions executed by a processing device and/or suitably programmed or configured hardware.

Figure 3:
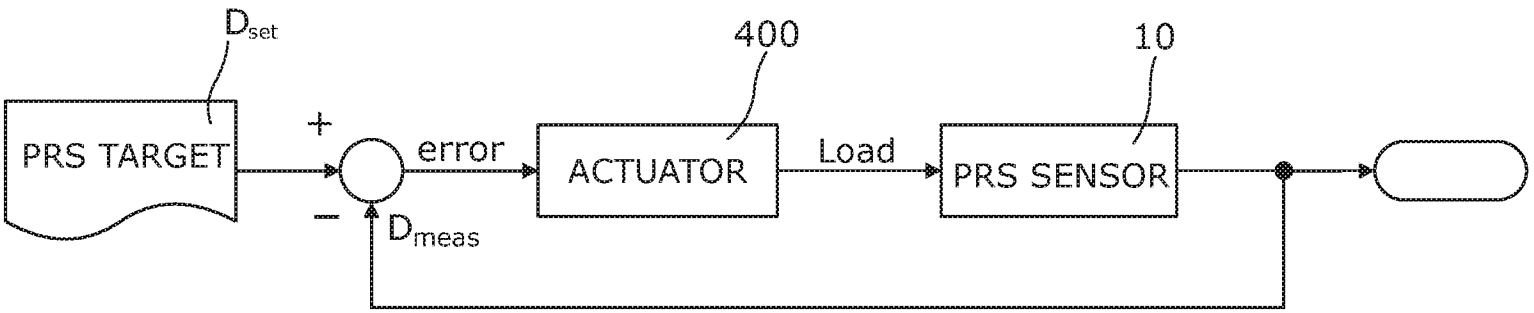
FIG. 3 shows a control diagram that may be used, for example, by a carriage arrangement as the one of FIG. 2.

An example of a closed-loop configuration that may be implemented in the controller 9 is shown in FIG. 3. In this example, the controller 9 has access to a memory wherein a PRS target Dset is stored and to readings from a PRS sensor 10, i.e., a measured distance Dmeas. The controller 9 is to determine the error between the measured distance Dmeas and the PRS target Dset and control the actuator 400 to reduce the error.

Figure 4:
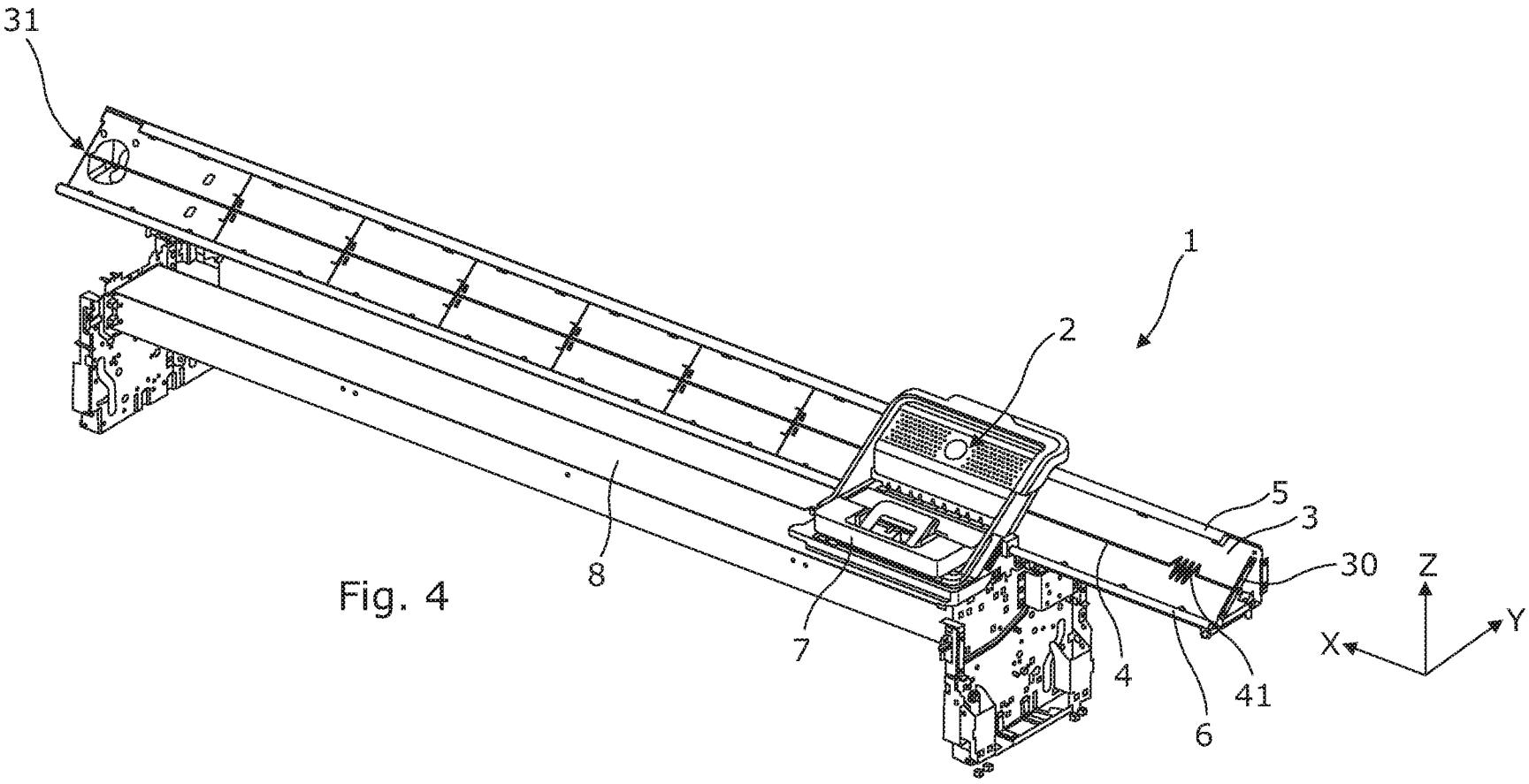
FIG. 4 shows a perspective view of an example carriage arrangement.

FIG. 4 shows an example of a carriage arrangement 1 for a printing system. In the example of FIG. 4, the carriage arrangement comprises a beam 3 and a carriage 2 to move longitudinally along the beam in the longitudinal direction of the beam 3. The movement between the carriage 2 and the beam 3 may be performed by providing the beam 3 with a guide 5 being the carriage 2 to slide along the guide 5.

Furthermore, it is shown an alignment rod 6 that is to be received by a bore provided in the carriage 2 to allow the displacement of the carriage 2 along the rod 6 thereby ensuring its alignment.

Figure 5:
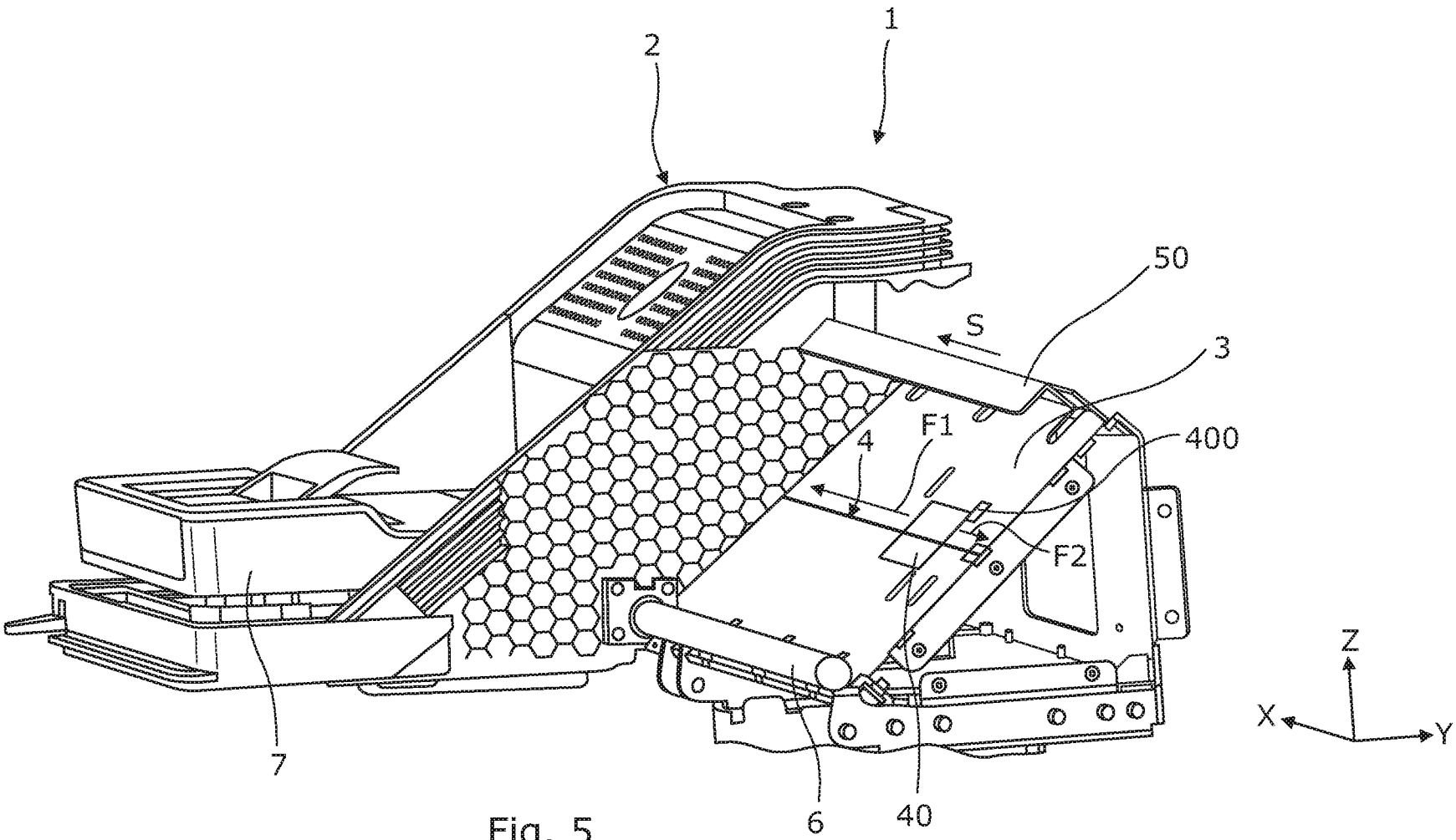
FIG. 5 shows a detailed view of an example carriage arrangement.

As can be seen, in particular, in FIG. 5, the carriage guide 5 may be a U-shaped or L-shaped profile rigidly attached to the beam 3 as to provide a stepped surface having an upper surface separated from the beam by a larger distance and a lower surface that corresponds to the beam 3 or is closer to the beam than the upper surface. Such a configuration allows for the system to accommodate elements with a larger volume, e.g., a motor, or even the carriage in the lower surface whereas the upper surface contacts the guide 5 to move the carriage.

The drive mechanism for the carriage may, in an example, comprise a motor, for example, a servomotor that may be fed by an energy source by pulse width modulation (PWM) signal. In response to the receipt of the energy from the energy source the motor may generate a rotational movement in an axis. Then, the motor may comprise an intermediate element to transform such rotational movement into a linear movement along a carriage guide 5.

Also, in an example, the carriage 2 may be provided with a PRS sensor that moves together with the carriage 2. This sensor may be an optical sensor to help determine the distance between the carriage 2 and a reference associated to the substrate and/or the platen. Such sensor may comprise a communication channel with a processor within the system as to provide the system with a PRS. In a further example, the carriage arrangement 1 may also comprise an encoder associated to the motor that may help in determining the position of the carriage 2 along the guide 5.

The carriage 2 comprises a housing 7 that, in an example, is to receive a printhead, the printhead comprising a set of nozzles to eject a printing fluid towards the print medium. In other examples, the carriage 2 may be associated to a scan bar and may be moved along the length of a substrate as to scan it.

In an example, the housing 7 comprises a receptacle wherein the PRS sensor may be provided. In this particular example, the PRS sensor may be provided at similar height than a printhead and may, therefore, establish with a higher accuracy the distance between a printhead and a reference in each position along the beam 3.

As shown in FIG. 5, the beam compensation mechanism comprises an actuator 40 that is to exert a tensioning force on the beam 3. The actuator, may be to exert a force in a first direction F1 and/or in a second direction F2 as to tension the beam thereby preventing its deformation or, at least, preventing that the deformation of the beam influences the PRS. The actuator 40 may be a pneumatic, hydraulic or mechanical actuator and in an example, may be an actuator whose force changes with the deformation of the beam 3, i.e., if the beam is deformed by a bigger magnitude the force exerted by the actuator is also bigger. Examples of these type of actuators may be a spring, a bellow or a closed-loop actuator.

In an alternative embodiment the actuator 40 may be to exert a compression force on the beam 3 as to compensate for its deformations. In an example, the lower portion of the beam 3 may be subject to a higher temperature than the upper portion of the beam. Due to the higher temperature of the lower portion the beam 3, if uncompensated, may deform reducing the PRS. In this case, the actuator 40 may be to issue a compression force on the beam 3 on the lower portion as to compensate for such a deformation.

Furthermore, in the examples provided in FIGS. 4 and 5, the beam compensation mechanism is provided on the same face of the carriage, however, in further embodiments, the beam compensation mechanism may be provided in other faces of the beam as to provide an arrangement that does not interfere with the movement of the carriage, for example, a face opposite to the face in which the carriage is provided.

The preceding description has been presented to illustrate and describe certain examples. Different sets of examples have been described; these may be applied individually or in combination, sometimes with a synergetic effect. This description is not intended to be exhaustive or to limit these principles to any precise form disclosed. Many modifications and variations are possible in light of the above teachings. It is to be understood that any feature described in relation to any one example may be used alone, or in combination with other features described, and may also be used in combination with any features of any other of the examples, or any combination of any other of the examples.

The invention claimed is:

1. A carriage arrangement comprising:

a carriage;

a carriage beam;

a drive mechanism;

wherein the carriage is to move along a longitudinal direction of the carriage beam upon action by the drive mechanism and wherein the carriage arrangement comprises a beam compensation mechanism to exert a variable compensating force on the carriage beam, the variable compensating force depending on a deformation amount of the carriage beam.

2. The carriage arrangement of claim 1 wherein the beam compensation mechanism exerts a force in the longitudinal direction of the carriage beam.

3. The carriage arrangement of claim 1 wherein the beam compensation mechanism comprises an actuator to exert the compensating force on the carriage beam.

4. The carriage arrangement of claim 3, wherein the actuator comprises an elastomer.

5. The carriage arrangement of claim 1 wherein the beam compensation mechanism comprises a sensor to determine a distance between the beam and a reference.

6. The carriage arrangement of claim 5 wherein the beam compensation mechanism comprises a controller coupled to the sensor, being the controller to issue a signal to a closed-loop actuator being the closed-loop actuator to exert the compensating force on the carriage beam.

7. The carriage arrangement of claim 5 wherein the sensor is an optical sensor.

8. A printing system comprising:

a print medium support surface to support a print medium;

a conveyor to transport the print medium along a media path direction a carriage extending over the print medium support, the carriage having a longitudinal direction perpendicular to the media advance direction wherein the system comprises a beam compensation mechanism comprising an actuator to exert a variable compensating force on the carriage beam.

9. The system of claim 8 wherein the variable compensating force is a force in the longitudinal direction of the carriage beam.

10. The system of claim 8 wherein the actuator is an open-loop actuator.

11. The system of claim 10 wherein the actuator is a pre-loaded elastomer attached to the carriage beam.

12. The system of claim 11, wherein a pre-load of the pre-loaded elastomer is configurable by a user.

13. The system of claim 8 wherein the system further comprises a sensor to determine a calibration distance associated to the carriage beam and the print medium or the print medium support.

14. The system of claim 13 further comprising a controller, the controller being to receive the calibration distance, to determine the variable compensating force in view of the calibration distance, and to control the actuator to exert the variable compensating force in view of such calibration signal.

15. A method to compensate for carriage beam deformations in a printing system comprising a carriage associated to the carriage beam and a compensation mechanism coupled to the carriage beam as to exert a variable compensating force on the carriage beam, the method comprising:

determining a reference distance; and adjusting the variable compensating force based on the reference distance.

* * * * *